US005458199A

United States Patent [19]

Collins et al.

[11] Patent Number: 5,458,199

[45] Date of Patent: Oct. 17, 1995

[54] ASSEMBLY AND PROCESS FOR DRILLING AND COMPLETING MULTIPLE WELLS

[75] Inventors: Gary J. Collins, Richmond, Tex.; Ervin Baudoin, Lafayette, La.

[73] Assignee: Marathon Oil Company, Findlay, Ohio

[21] Appl. No.: 170,557

[22] Filed: Dec. 20, 1993

Related U.S. Application Data

[63] Continuation-in-part of Ser. No. 80,042, Jun. 18, 1993, Pat. No. 5,330,007, which is a continuation-in-part of Ser. No. 936,972, Aug. 28, 1992, abandoned.

[51] Int. Cl.[6] ..... E21B 33/047; E21B 43/01; E21B 43/14

[52] U.S. Cl. ..... 166/313; 166/97.5; 166/366; 166/368; 175/61

[58] Field of Search ..... 166/89, 97.5, 366, 166/313, 341, 242, 368, 50; 175/61, 8, 9, 78, 79, 5

[56] References Cited

U.S. PATENT DOCUMENTS

| | | | |
|---|---|---|---|
| 1,900,163 | 3/1933 | Dana et al. . | |
| 1,900,164 | 3/1933 | Dana et al. . | |
| 2,492,079 | 12/1949 | Wiley . | |
| 2,794,505 | 6/1957 | Allen | 166/86 |
| 3,011,552 | 12/1961 | Rhodes et al. | 166/67 |
| 3,052,301 | 9/1962 | Watts et al. | 166/97 |
| 3,100,529 | 8/1963 | McStravick et al. | 166/52 |
| 3,118,502 | 1/1964 | Cochran | 166/129 |
| 3,223,168 | 12/1965 | Stone | 166/89 |
| 3,269,755 | 8/1966 | Yancey | 285/137 |
| 3,330,355 | 7/1967 | Yancey | 166/46 |
| 3,653,435 | 4/1972 | Reistle, III et al. | 166/0.5 |
| 4,068,729 | 1/1978 | Peevey | 175/8 |
| 4,396,075 | 8/1983 | Wood et al. | 175/79 |
| 4,415,205 | 11/1983 | Rehm et al. | 299/5 |
| 4,444,276 | 4/1984 | Peterson, Jr. | 175/61 |
| 4,573,541 | 3/1986 | Jossee et al. | 175/78 |
| 4,749,046 | 6/1988 | Gano | 166/366 |
| 4,822,212 | 4/1989 | Hall et al. | 405/227 |

OTHER PUBLICATIONS

M. E. Teel, "What's Happening In Drilling," pp. 25 and 36, World Oil, Nov. 1993.

*Primary Examiner*—Stephen J. Novosad
*Attorney, Agent, or Firm*—Jack L. Hummel; Jack E. Ebel

[57] ABSTRACT

A process for drilling and completing multiple subterranean wells from a common well bore and an assembly for guiding a drill string during drilling and casing during completion of such multiple wells. The assembly comprises a wellhead located at or near the surface of the earth and positioned over the common well bore, at least two tubulars positioned within the common well bore, and means positioned at said wellhead for segregating and supporting the tubulars. In accordance with the process, at least one subterranean well bore is drilled through one of the tubulars and into a subterranean formation and hydrocarbons can be produced from the subterranean formation to the surface via production casing and/or production tubing positioned within the subterranean well bore. Other subterranean well bores can be drilled in a similar manner through other tubulars of the assembly.

36 Claims, 9 Drawing Sheets

ASSEMBLY AND PROCESS FOR DRILLING AND COMPLETING MULTIPLE WELLS

CROSS-REFERENCE TO RELATED APPLICATIONS

This application is a continuation-in-part of U.S. patent application, Ser. No. 08/080,042 filed Jun. 18, 1993, now No. 5,330,007, which is a continuation-in-part of U.S. patent application, Ser. No. 07/936,972, filed Aug. 28,1992, and now abandoned.

BACKGROUND OF THE INVENTION

1. Field of the Invention

The present invention relates to an assembly and process for drilling multiple subterranean wells from a single or common well bore and for completing such wells via separate casings positioned within the common well bore, and more particularly, to such assembly and process for drilling and completing multiple subterranean wells from a single or common well bore which will permit such wells to be separated at or near the surface of the earth during and after drilling and completion.

2. Description of Related Art:

Increasingly, well bores are being drilled into subterranean formations at an orientation which is purposely deviated from true vertical by means of conventional whipstock technology or a mud motor secured in the drill string adjacent the drill bit. In fractured subterranean formations, deviated wells are utilized to increase the area of drainage defined by the well within the subterranean formation, and thus, increase production of hydrocarbons from the subterranean formation. An inherent problem in utilizing a conventional whipstock to drill a deviated well is that both the depth and radial orientation of the whipstock is set when the whipstock is positioned in the well bore and cannot be changed without retrieving the whipstock from the well bore and changing the depth and/or radial orientation thereof.

In addition, wells drilled from offshore drilling platforms are usually deviated to increase the number of wells which can be drilled and completed from a single platform. Offshore drilling platforms which are utilized in deep water to drill and complete wells in a subterranean formation vary in size, structure, and cost depending upon the water depth and the loads in which the platform will be set. For example, a platform may be constructed to be supported in part by one leg or caisson which extends to the ocean floor or by as many as eight such legs or caissons. Costs of such offshore drilling platforms vary from approximately $5,000,000 to $500,000,000. Each offshore drilling platform is equipped with a set number of slots via which deviated wells can be drilled and completed through casings which are secured to the platform by conventional techniques.

Thus, a need exists for an assembly and processes for drilling and completing multiple cased wells from a single or common well bore so as to reduce capital expenditures for onshore and offshore wells.

Accordingly, it is an object of the present invention to provide an assembly and a process for drilling and completing multiple wells within subterranean formation(s) from a single or common well bore wherein such multiple wells are separated during and after drilling and completion at or adjacent to the surface of the earth.

It is another object of the present invention to provide an assembly and a process for drilling and completing multiple wells within subterranean formation(s) from a single or common well bore without using moveable downhole components.

It is a further object of the present invention to complete such multiple, cased wells in a manner such that remedial operations can be conducted on one well while hydrocarbons from the subterranean formation are simultaneously being produced from or fluid is being injected into such formation by means of the other well(s) which are completed via separate casings.

It is a still further object of the present invention to provide such an assembly and process for drilling multiple cased wells from a single or common well bore which is relatively simple in construction, which permits production casing of each multiple well to separately depend from the surface apparatus, and which provides that the separate production casing of each multiple well extend from the subterranean formation of interest to the surface.

SUMMARY OF THE INVENTION

To achieve the foregoing and other objects, and in accordance with the purposes of the present invention, as embodied and broadly described herein, one characterization of the present invention is an assembly through which multiple subterranean wells can be separately drilled and completed from a common well bore. The assembly comprises a wellhead located at or near the surface of the earth and positioned over a common well bore, first and second tubulars positioned within the common well bore, and means positioned at the wellhead for segregating and supporting the first and second tubulars. The first tubular is sized to permit passage of a drill string therethrough during drilling of a first subterranean well bore from the common well bore and to permit production casing to be positioned therethrough when the first subterranean well bore is completed. In a similar manner, the second tubular is sized to permit passage of a drill string therethrough during drilling of a second subterranean well bore from the common well bore and to permit production casing to be positioned therethrough when the second subterranean well bore is completed.

In another characterization of the present invention, a wellhead assembly is provided which comprises a first means for segregating and supporting at least two tubulars which are positioned within a common subterranean well bore and a second means for supporting at least two production casings which extend into separate subterranean well bores drilled from said common subterranean well bore. One of the production casings extends through one of the tubulars, while another of the production casings extends through another of the tubulars.

In yet another characterization of the present invention, a process of drilling and completing subterranean wells is provided. In accordance with this process, two separate tubulars are suspended from a wellhead of a common well bore and are positioned within the common well bore. A first subterranean well bore is drilled through one of the two tubulars and into a subterranean formation and a first length of production casing is secured to the wellhead. The first length of production casing extends into the first well bore and is supported at the well head so as to establish fluid communication between the subterranean formation penetrated by the first well bore and the surface of the earth.

In still a further characterization of the present invention, a process is provided for drilling at least two subterranean well bores from a common well bore. The process comprises positioning at least two tubulars within the common well bore and drilling separate subterranean well bores through each of said at least two tubulars and into subterranean formation(s).

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
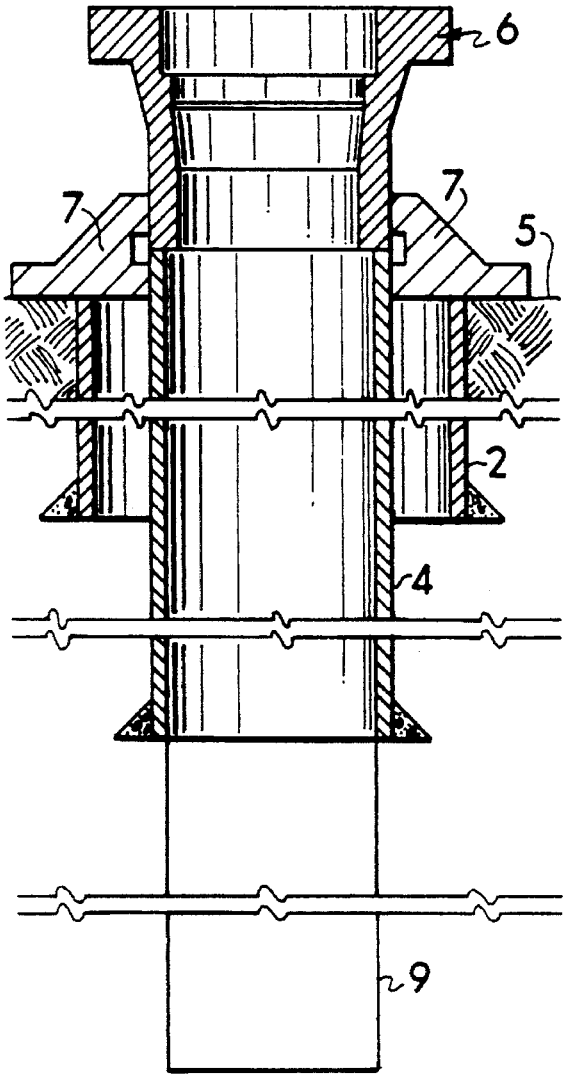
FIG. 1 is a sectional view of the assembly of the present invention as positioned over a well bore.

As illustrated in FIG. 1, a relatively large diameter tubular or pipe 2, for example a 30 inch diameter pipe, is driven into the ground, either onshore or offshore, by percussion or any other suitable means to a relatively shallow depth at which the pipe refuses to be driven. Alternatively, a large diameter hole, for example a 36 inch diameter hole, can be drilled into the earth by any conventional means as will be evident to a skilled artisan and the relatively large diameter tubular or pipe 2, for example a 30 inch diameter pipe, is positioned within the hole and cemented therein. Thereafter, a slightly smaller diameter well bore is drilled through pipe 2 to a depth of, for example 1200 feet, and conductor pipe 4 is positioned and cemented within this well bore in a conventional manner as will be evident to a skilled artisan. A wellhead 6 having a plurality of legs or pads 7 is positioned upon pipe 2 and casing 4 such that the bottom of legs 7 rest upon the upper end of pipe 2 and either the surface of the earth if onshore or the cellar deck of an offshore drilling platform, both illustrated as 5 in FIG. 1. The upper end of conductor pipe 4 is received within wellhead 6 and secured thereto by any suitable means, such as welds (not illustrated). The well bore is then drilled through casing 4 to an appropriate depth, e.g., about 3500–4000 feet. The resultant well bore 9 may either be vertical or deviated.

Figure 2:
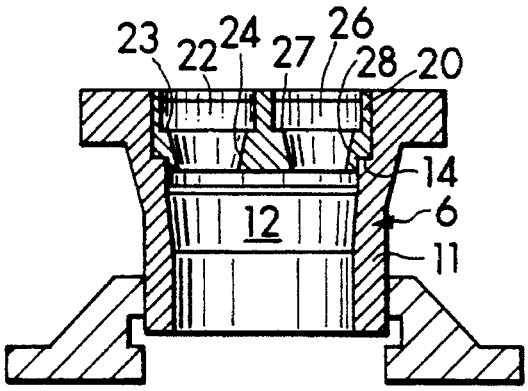
FIG. 2 is a sectional view of a dual bore insert as positioned in and supported by the assembly of the present invention.
Figure 3:
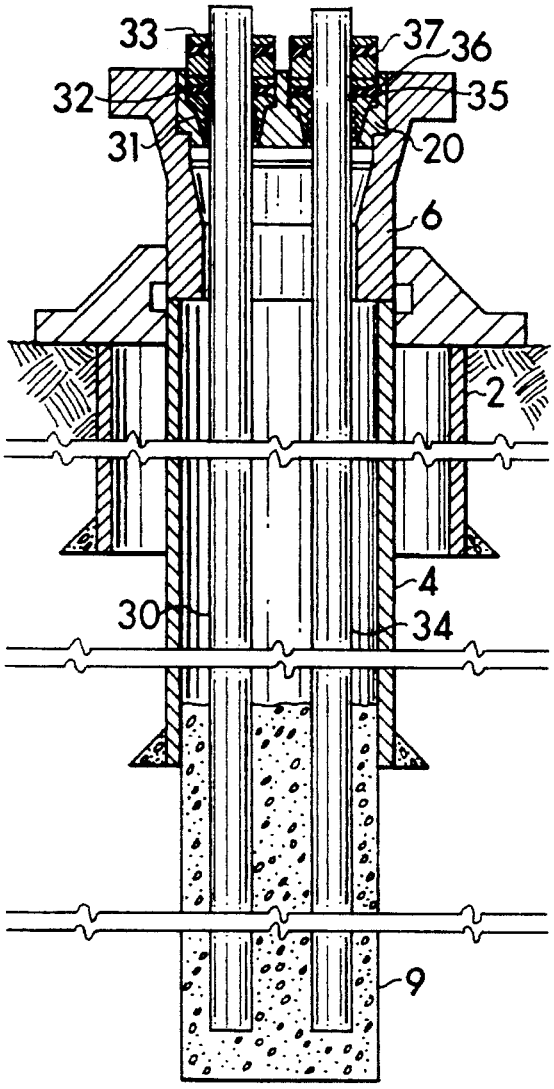
FIG. 3 is a sectional view of the assembly of the present invention illustrating two tubulars depending from the wellhead.

Referring to FIG. 2, wellhead 6 has a bore 12 therethrough of varying diameter which defines a generally annular shoulder 14. An insert 20 is positioned within bore 12 and supported upon generally annular shoulder 14. Insert 20 has at least two bores 22, 26 therethrough of varying diameter which define generally annular shoulders 23, 27 and tapered sections 24, 28, respectively. As illustrated in FIG. 3, a plurality of tubulars 30, 34 which correspond in number to the number of bores through insert 20 are positioned through bores 22 and 26 in a manner as hereinafter described and are secured therein by, for example, conventional casing slips 31, 35 which are expanded into engagement with insert 20 upon being lowered into contact with tapered sections 24, 28, respectively. Casing slips 31,35 are provided with seals 32, 36 which can be constructed of any suitable material, for example an elastomer. Any other conventional means, such as split mandrel hangers, can be utilized in lieu of casing slips 31,35 to secure tubulars 30, 34 to insert 20. Tubulars 30, 34 are also provided with conventional packoff seal rings 33, 37. As utilized throughout this description, "tubular" refers to string of pipe, such as casing, conventionally positioned within a subterranean well bore and usually made up of individual lengths of pipe which are secured together by, for example, screw threads.

Figure 4:
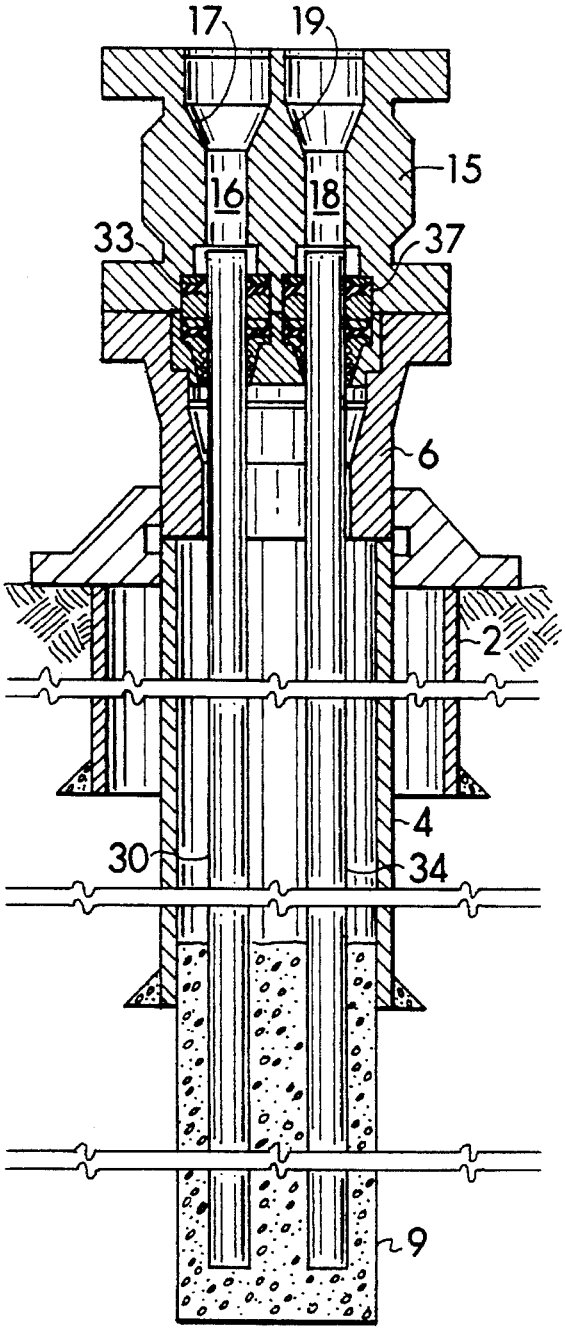
FIG. 4 is a sectional view of the assembly of the present invention depicting sections of the wellhead secured together during construction of the assembly.

Once tubulars 30, 34 are secured to insert 20, a dual bore wellhead 15 (FIG. 4) is secured to wellhead 6 by any suitable means, such as by bolts (not illustrated), and has two bores 16, 18 therethrough which are substantially aligned with tubulars 30, 34. The diameter of each of bore 16, 18 is restricted along the length thereof thereby defining annular shoulders 17, 19, respectively. As assembled, packoff seal rings 33 and 37 function to provide a fluid tight seal between tubulars 30, 34 and dual bore wellhead 15. As thus positioned within well bore 9, tubulars 30 and 34 are cemented in a conventional manner, preferably by transporting a cement slurry via only one of the tubulars. It is preferred that the cement deposited in well bore 9 extend into casing 4.

Figure 5:
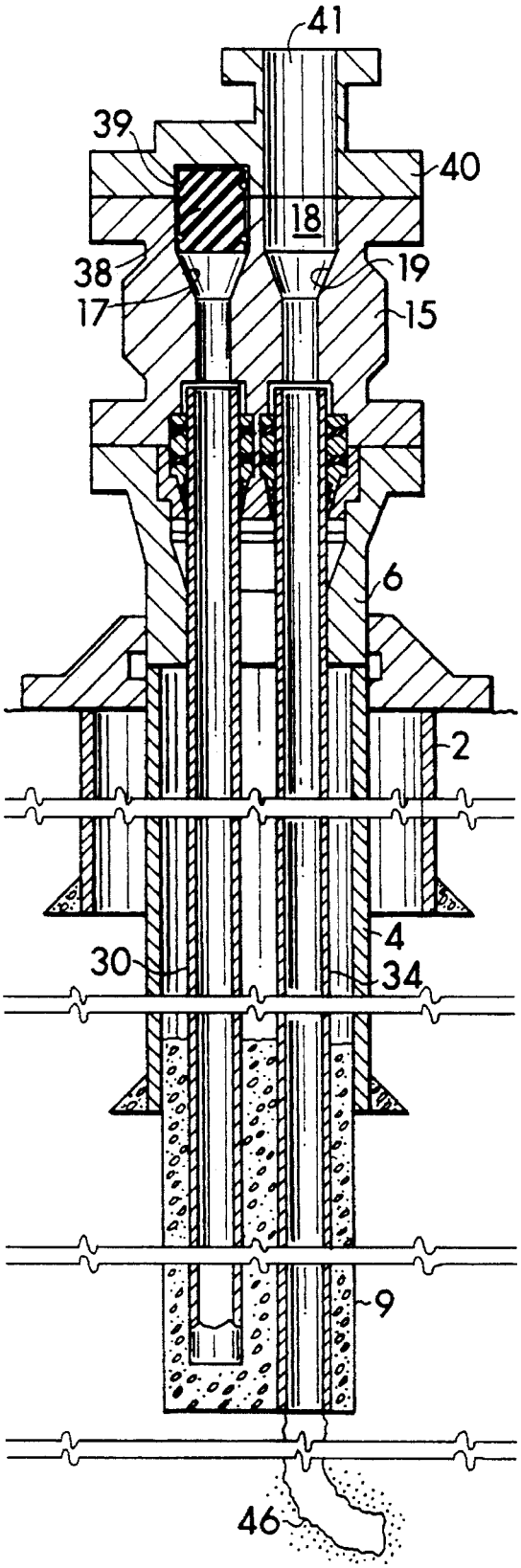
FIG. 5 is a sectional view of the assembly of the present invention including a drilling flange utilized for drilling a first subterranean well bore through one bore of a dual bore wellhead and associated tubular of the assembly.

Thereafter, a plug 38 having seals 39, for example elastomeric O-rings, is positioned within the upper end of one of bores 16 or 18 through dual bore wellhead 15 (bore 16 as illustrated in FIG. 5) and a drilling flange 40 is secured to dual bore wellhead 15 by any suitable means, such as by bolts (not illustrated). Flange 40 has a bore 41 therethrough which is substantially aligned with bore 18 and tubular 34 so as to permit passage of a drilling string therethrough. Further, flange 40 is sized to be coupled to a conventional blow out preventer for safety during drilling as will be evident to a skilled artisan. As thus assembled, drilling flange 40, wellhead 6, dual bore wellhead 15 and tubulars 30, 34 provide an assembly through which two wells can be separately drilled and completed from the surface in a manner as hereinafter described so as to eliminate the need for downhole tools having moveable parts and the problems associated therewith. This assembly can be used during drilling of wells from onshore drilling rigs and/or offshore drilling platforms.

Figure 6:
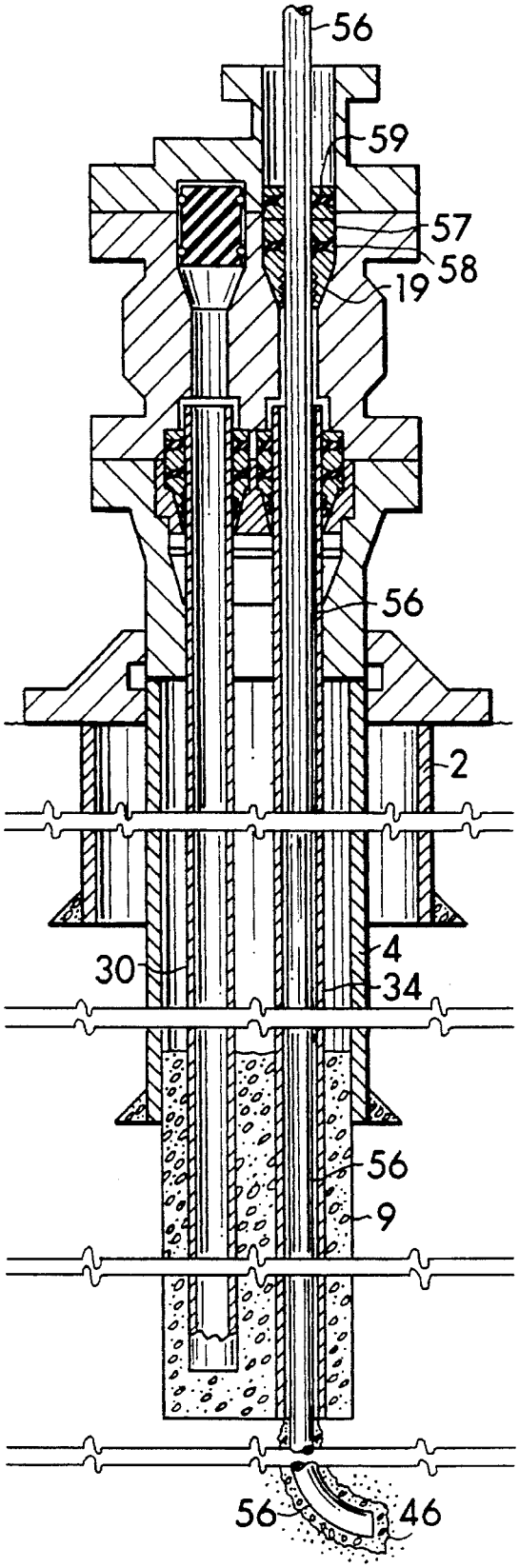
FIG. 6 is a partially sectioned view of the assembly of the present invention illustrating production casing positioned within a first subterranean well bore drilled utilizing the assembly of the present invention.

A drilling string having a drill bit secured to one end thereof is passed through bores 41 and 18 and tubular 34 to drill out any hardened cement present therein. The drilling string is advanced from the bottom of tubular 34 and a generally vertical or a deviated well bore 46 is drilled therefrom in a conventional manner so as to penetrate a subterranean formation or zone. Once the well bore is drilled from tubular 34 and logged, if desired, production casing 56 (FIG. 6) is lowered from the surface until a portion thereof is positioned within well bore 46. The production casing 56 is first cemented within well bore 46 in a conventional manner with cement preferably extending up to the bottom of tubular 34. Prior to the cement setting, production casing 56 is secured within bore 18 of dual bore wellhead 15 by means of conventional casing slips 57 which are expanded into engagement with bore 18 of dual bore wellhead 15 upon contacting annular shoulder 19. Casing slips 57 are provided with a seal 58 to provide a fluid tight seal between bore 18 of dual bore wellhead 15 and production casing 56. The upper end of production casing 56 is also provided with conventional packoff seal rings 59.

Figure 7:
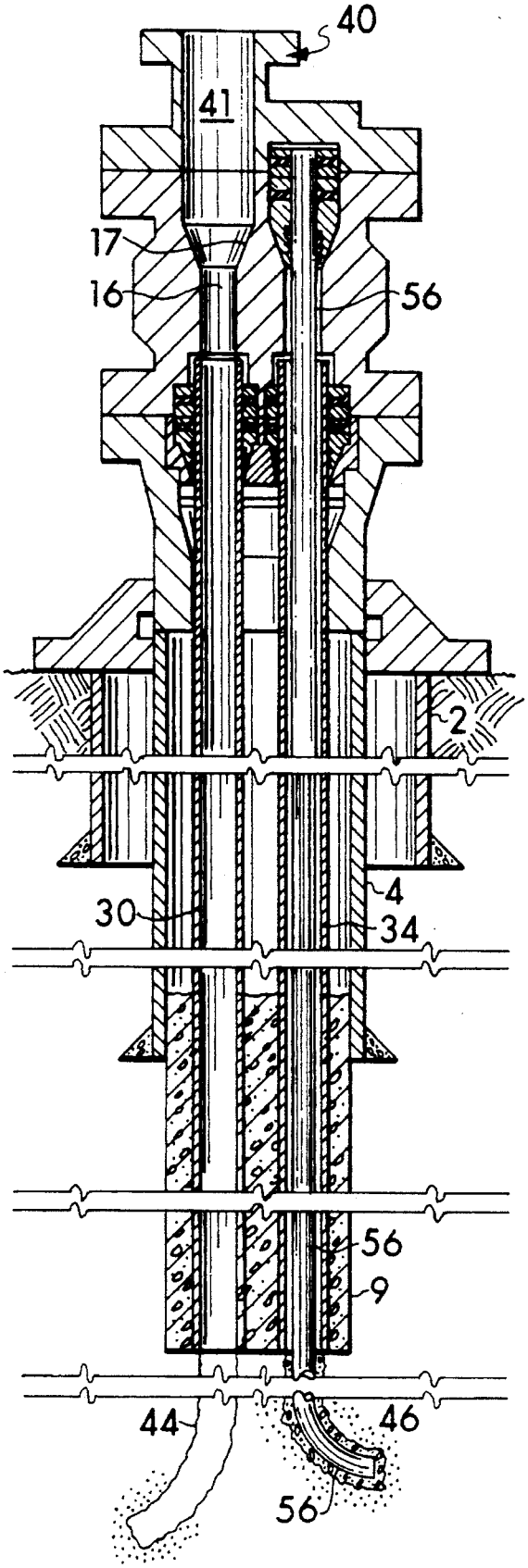
FIG. 7 is a partially sectioned view of the assembly of the present invention including a drilling flange utilized for drilling a second subterranean well bore through another bore of the dual bore wellhead and associated tubular of the assembly.
Figure 8:
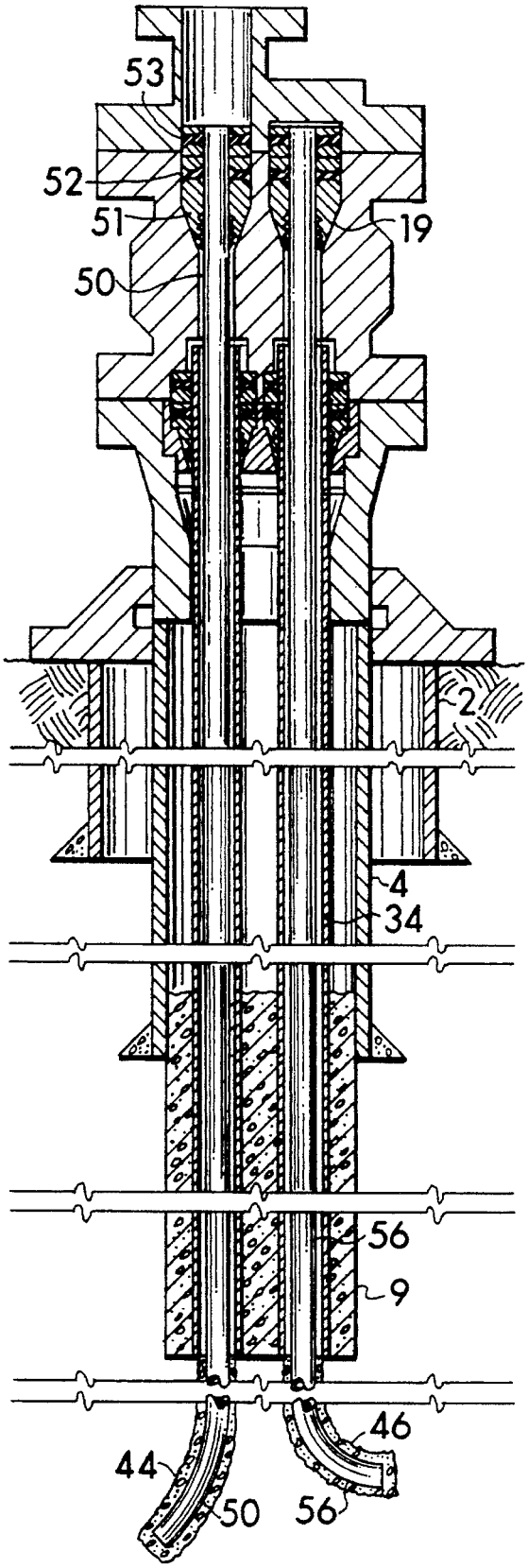
FIG. 8 is a partially sectioned view of the assembly of the present invention illustrating production casing positioned within a second subterranean well bore drilled utilizing the assembly of the present invention.

Once production casing 56 is thus secured within bore 18 of dual bore wellhead 15 and cemented within well bore 46, drilling flange 40 is removed from dual bore wellhead 15 and the portion of production casing 56 extending beyond packoff seal rings 59 is severed or cut by conventional tools and plug 38 is removed from the upper end of bore 16. Drilling flange 40 is again secured to dual bore wellhead 15 by any suitable means, such as by bolts (not illustrated),so that bore 41 through flange 40 is substantially aligned with bore 16 and tubular 30 so as to permit passage of a drilling string therethrough (FIG. 7). A conventional blow out preventer is again secured to drilling flange 40 to ensure safety during drilling. A drilling string having a drill bit secured to one end thereof is passed through bores 41 and 16 and tubular 30 to drill out any hardened cement present therein. The drilling string is advanced from the bottom of tubular 30 and a vertical or a deviated well bore 44 is drilled therefrom in a conventional manner so as to penetrate a subterranean formation. Once this well bore is drilled from tubular 30 and logged, if desired, production casing 50 is lowered from the surface until a portion thereof is positioned within well bore 44 as illustrated in FIG. 8. The production casing 50 is first cemented within well bore 44 in a conventional manner with cement preferably extending up to the bottom of tubular 30. Prior to the cement setting, production casing 50 is secured within bore 16 of dual bore wellhead 15 by means of conventional casing slips 51 which are expanded into engagement with bore 16 upon contacting annular shoulder 17. Casing slips 51 are provided with seals 52 to provide a fluid tight seal between bore 16 of dual bore wellhead 15 and production casing 50. The upper end of production casing 50 is also provided with conventional packoff seal rings 53. Any other conventional means, such as mandrel hangers, can be utilized in lieu of casing slips 51, 57 to secure production casing 50, 56, respectively, to dual bore wellhead 15. Once production casing 50 is thus secured within bore 16 of dual bore wellhead 15 and cemented within well bore 44, drilling flange 40 is removed from dual bore wellhead 15 and the portion of production casing 50 extending beyond packoff seal rings 53 is severed or cut by conventional tools (FIG. 9).

Figure 9:
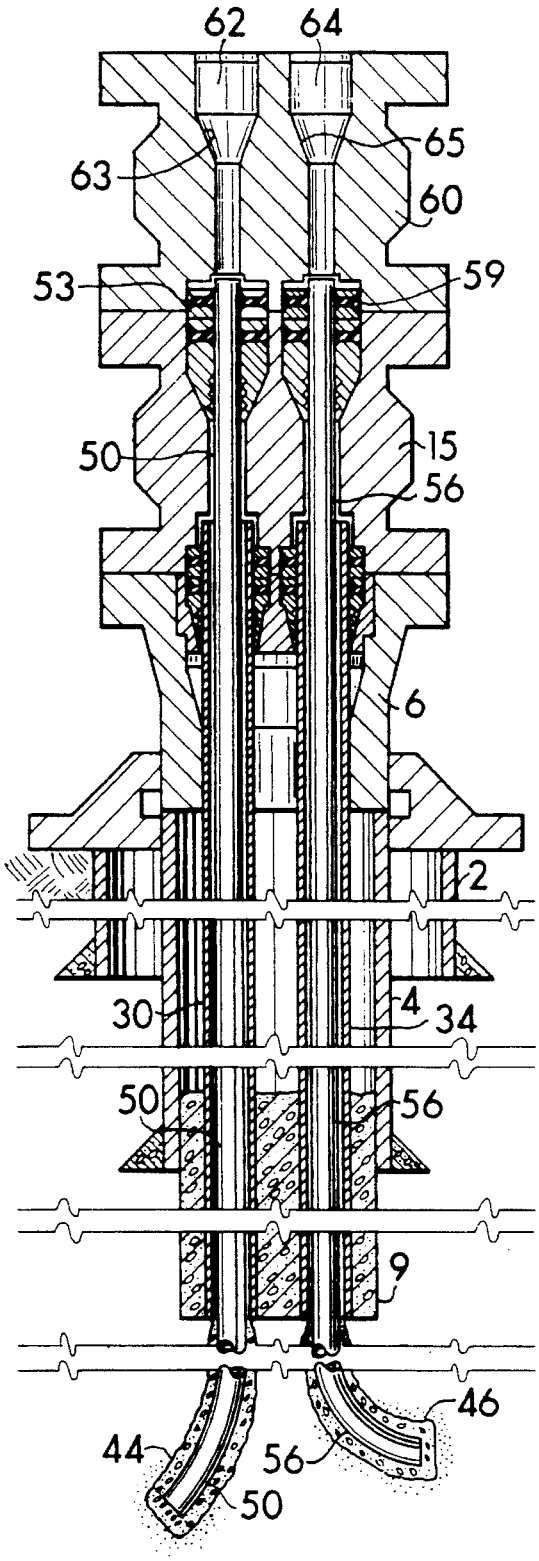
FIG. 9 is a partially sectioned view of the assembly of the present invention including a dual bore tubing spool.
Figure 10:
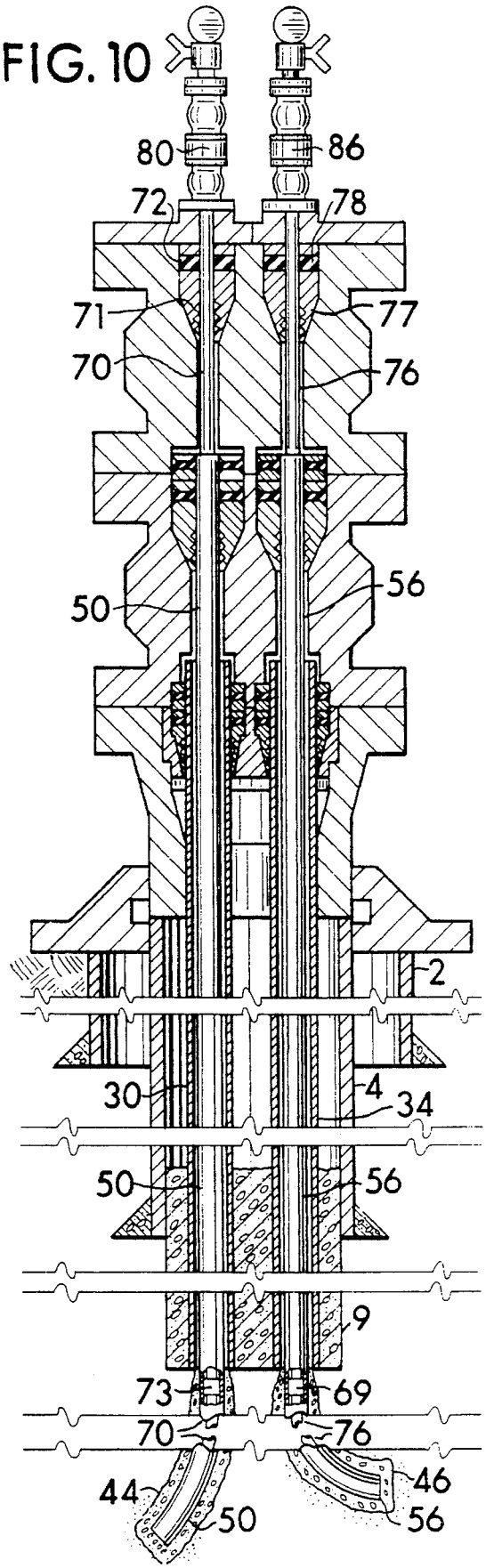
FIG. 10 is a partially sectioned view of the assembly of the present invention having separate production tubing positioned within first and second subterranean well bores drilled utilizing the assembly of the present invention, each well bore having separate production trees at the surface.

As illustrated in FIG. 9, a dual bore tubing spool 60 is secured onto dual bore wellhead 15 by any suitable means, such as by bolts (not illustrated),so that bores 62 and 64 through spool 60 are substantially aligned with production casing 50 and 56, respectively. Each of bores 62, 64 has a restriction in diameter which defines tapered sections 63, 65. Packoff seal rings 53, 59 function to provide a fluid tight seal between production casing 50, 56, respectively, and tubing spool 60. Production casings 50 and 56 are then placed in fluid communication with the subterranean formation(s) which each penetrate by any suitable means, for example by perforations, such that fluids, preferably hydrocarbons, enter casings 50 and 56 for production to the surface. As illustrated in FIG. 10, smaller diameter production tubing 70, 76 are positioned within production casing 50, 56, respectively, and are supported by means of conventional tubing hangers 71, 77 which are hung off into tubing spool 60 upon the tubing hangers contacting annular shoulders 63 and 65, respectively. Any other conventional means, such as mandrel hangers, can be utilized in lieu of tubing hangers 71, 77 (as illustrated in FIG. 10) to secure production tubing 70, 76, respectively, to tubing spool 60. The upper end of production tubing 70, 76 are also provided with conventional packoffs 72 and 78 to provide a fluid tight seal between tubing spool 60 and production tubing 70 and 76. Separate production trees 80 and 86 are installed so as to be in fluid communication with production tubing 70 and 76, respectively.

Figure 11:
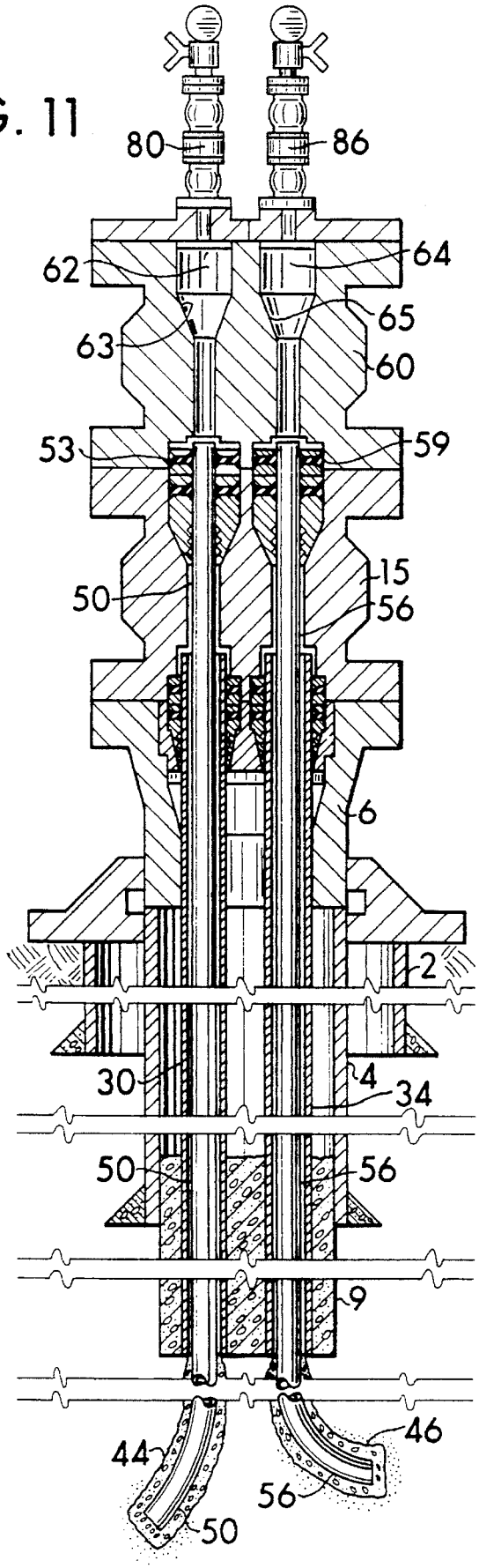
FIG. 11 is a partially sectioned view of the assembly of the present invention which is partially illustrated in FIG. 9, wherein the first and second subterranean well bores drilled utilizing the assembly of the present invention have separate production trees at the surface so as to permit production of subterranean fluid through production casing positioned within each well bore.

Alternatively, fluids from subterranean formation(s) penetrated by production casing 50 and 56 can be produced to the surface of the earth directly through the production casing without the use of production tubing depending upon the particular application as will be evident to the skilled artisan. In this embodiment, separate production trees 80 and 86 are installed onto tubing spool 60 so as to be in fluid communication with production casing 50 and 56, respectively, as illustrated in FIG. 11.

As thus drilled and completed in accordance with the present invention, two subterranean wells 44, 46 are drilled into the same or different subterranean formations or horizons, to identical or different total depths, and are each either vertical or deviated. Wells 44 and 46 are separately completed to the surface through a single or common well bore so that fluid can be simultaneously produced from and/or injected into the subterranean formation(s) via both wells. Or a remedial operation including, but not limited to workovers, recompletions, and side tracking, can be performed in one well while hydrocarbons are simultaneously produced from or fluid injected into a subterranean formation via the other well. In addition, fluid can be injected into a subterranean formation via one well as hydrocarbons are being produced from the same or a different subterranean formation via the other well.

Figure 12:
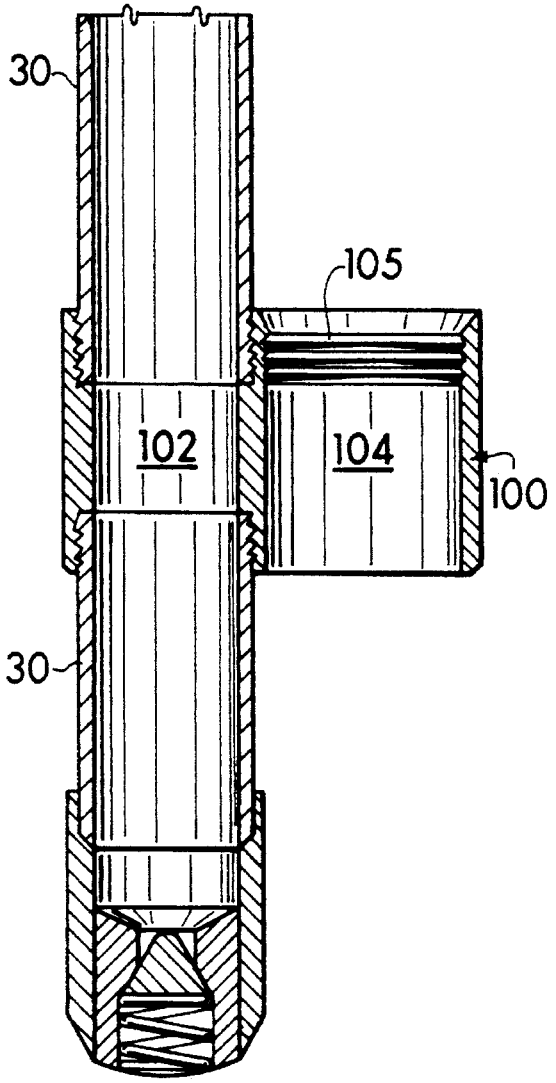
FIG. 12 is a cutaway, sectional view of one embodiment of a downhole tie-back assembly of the present invention as secured to one tubular.
Figure 13:
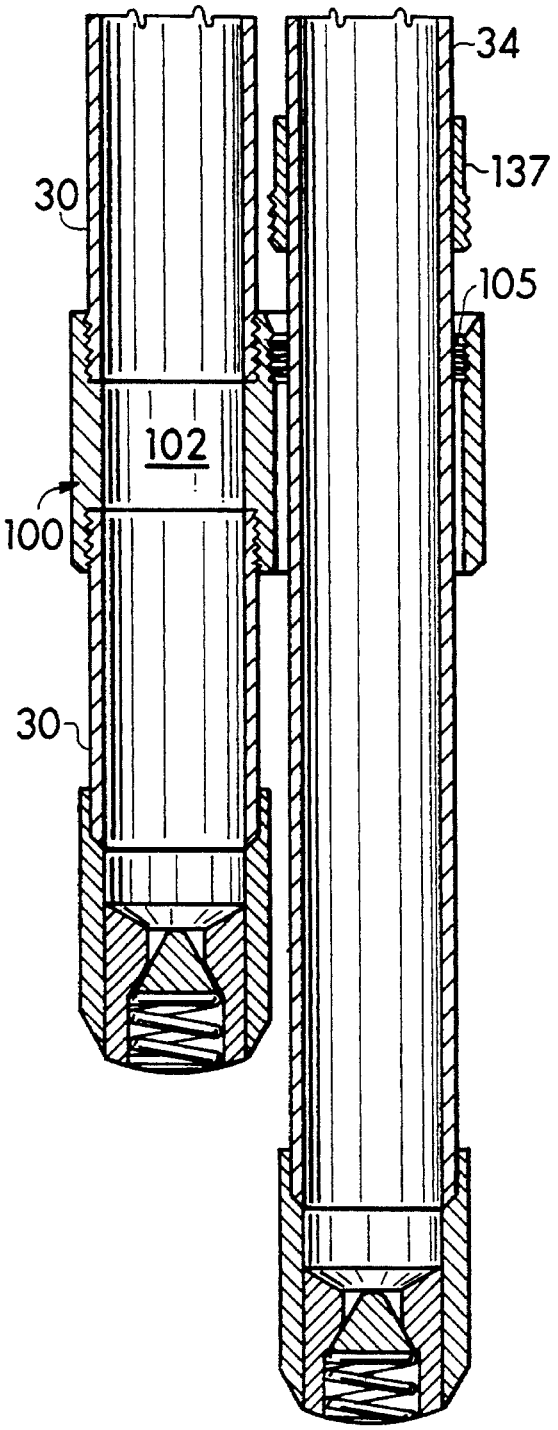
FIG. 13 is a cutaway, sectional view of the embodiment of a downhole tie-back assembly of the present invention illustrated in FIG. 12 showing a second tubular being lowered into engagement with a threaded bore through the tie back assembly.

Because of the length of tubulars 30 and 34 of the assembly of the present invention, e.g. about 3500 to about 4000 feet, it may be desirable to ensure that such tubulars remain separated near the lower end thereof as positioned within well bore 9. A downhole tie-back assembly is illustrated in FIG. 12 generally as 100 and has a first bore 102 and a second bore 104 therethrough. As positioned within the surface or common well bore, separate lengths of tubular 30 are secured within first bore 102 by means of, for example screw threads. Second bore 104 is provided with threads 105 which mate with a collet latch 37 secured to the exterior of tubular 34. As tubular 34 is lowered into the common well bore in a manner illustrated in FIG. 13, collet latch 37 snaps into engagement with threads 105 and secures tubular 34 to tie-back assembly 100 thereby fixing the relative relationship of tubulars 30 and 34 downhole. In this manner, the downhole structural stability of the assembly of the present invention is increased permitting increased directional control so as to minimize interference of well bores drilled and completed utilizing the assembly of the present invention.

Figure 14:
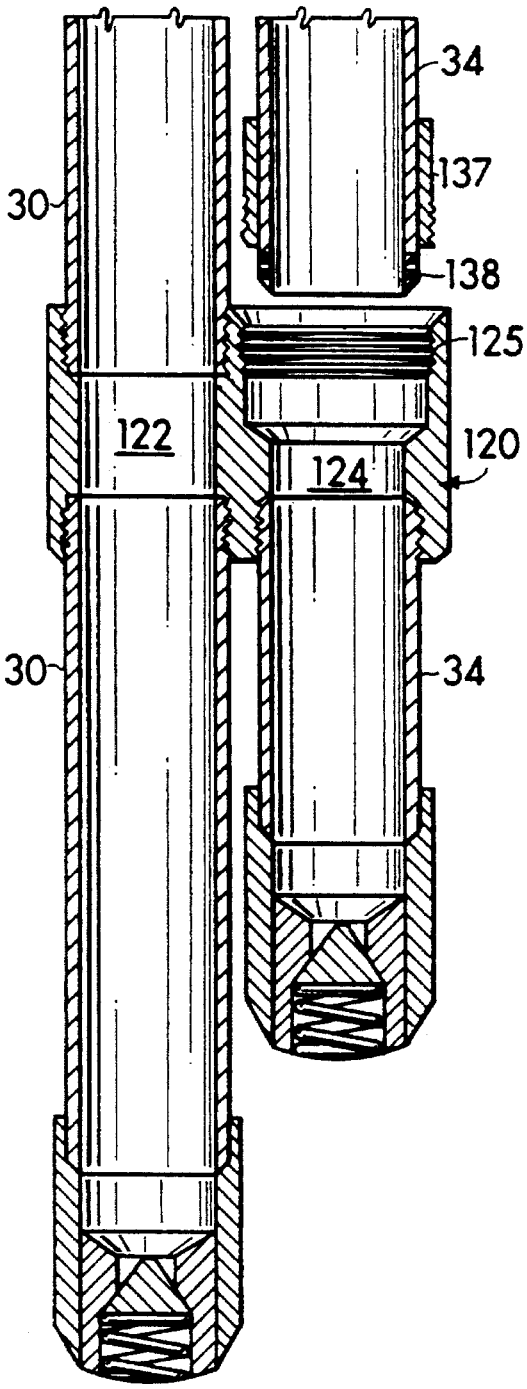
FIG. 14 is a cutaway, sectional view of another embodiment of a downhole tie-back assembly of the present invention as secured to one tubular and a portion of a second tubular, the remaining portion of the second tubular being lowered within the common well bore into engagement with a threaded bore through the tie back assembly.

An alternative downhole tie-back assembly is illustrated in FIG. 14 as 120 and has a first bore 122 and a second bore 124 therethrough. As positioned within the surface or common well bore, separate lengths of tubular 30 are secured within first bore 122 by means of, for example, screw threads, and one length of tubular 34 is similarly secured within second bore 124 so as to depend therefrom. A collet latch 37 is secured to the exterior of the lower end of the remaining lengths of tubular 34. As these remaining lengths of tubular 34 are lowered into the common well bore in a manner illustrated in FIG. 14, collet latch 137 snaps into engagement with threads 125 in second bore 124 and secures the remaining lengths of tubular 34 to tie-back assembly 120 thereby fixing the relative relationship of tubulars 30 and 34 downhole. Seals 1 38 in the lower end of tubular 34 provide a fluid tight seal between tubular 34 and tie back assembly 120.

The following example demonstrates the practice and utility of the present invention, but is not to be construed as limiting the scope thereof.

EXAMPLE 1

A 30 foot diameter pipe is driven 500 feet into the earth by percussion. A 26 inch diameter well bore is drilled through the 30 foot diameter pipe to a depth of 2000 feet and a 24 inch diameter is run into and cemented therein. A 26¾ inch diameter, 3000 psi starting wellhead is installed over the 24 inch diameter casing and swedged down to 24 inches. A well bore is conventionally drilled through this casing to surface casing depth, i.e. 4000 feet, and is underreamed to 24 inches in diameter. A downhole tie-back assembly is screwed onto 9⅝ inch diameter surface casing and run into the well bore. A dual bore insert is installed over the 9⅝ inch diameter surface casing and landed into 26¾ inch starting wellhead. The string of 9⅝ inch casing is then run through one bore of the insert to approximately 30 feet from the bottom of the well bore. The 9⅝ inch casing is secured within the insert by means of a mandrel hanger, and that portion of the first casing extending above the insert is removed from the mandrel hanger. A second string of 9⅝ inch diameter casing which is equipped with a collet latch is inserted through the second bowl of the insert and lowered to the tie-back assembly until the collet latch is secured to threads in a bore through the tie-back assembly. Both strings of 9⅝ inch casing are cemented within the well bore by circulating cement through the second string of 9⅝ inch casing run into the well bore. The second string of 9⅝ inch casing is then secured to the insert by means of a slip assembly and the portion of the second casing extending above the insert is cut and packoffs are installed over both casing strings.

A dual bore wellhead is installed onto the starting wellhead. A plug is inserted into the first bore of the dual bore wellhead and a drilling flange is installed onto the dual bore wellhead to provide access the second bore through the dual bore wellhead. Blow out preventers are rigged up to the drilling flange and pressure tested. A drilling string is passed through the second string of 9⅝ inch diameter casing to drill out cement and float equipment on the bottom of this casing. A well bore is then directionally drilled from the bottom of the second string of 9⅝ inch casing to a predetermined total depth of 10,000 feet. The well bore is logged and 7 inch diameter production casing is run into the well bore and cemented therein. Slips are then set to secure the casing to the dual bore wellhead. The portion of 7 inch production casing extending from the dual bore wellhead is then cut and packoff seals are then installed between the production casing and the dual bore wellhead.

The drilling flange is removed from the dual bore wellhead and the plug is removed from the first bore. The drilling flange is then installed onto the dual bore wellhead to access the first bore and isolate the first well drilled by means of the pack off seals. Blow out preventers are rigged up to the drilling flange and pressure tested. A drilling string is passed through the first string of 9⅝ inch diameter casing to drill out cement and float equipment on the bottom of this casing. A well bore is directionally drilled from the bottom of the first string of 9⅝ inch casing and away from the well which was previously drilled to a total depth of 12,000 feet. This well bore is then logged and 7 inch diameter production casing is run into the well bore and cemented therein. Slips are set to secure the casing to the dual bore wellhead. The portion of 7 inch production casing extending from the dual bore wellhead is cut and packoff seals are then installed between the production casing and the dual bore wellhead. A dual bore tubing spool is then installed and the two wells are separately completed with separate production trees.

Figure 15:
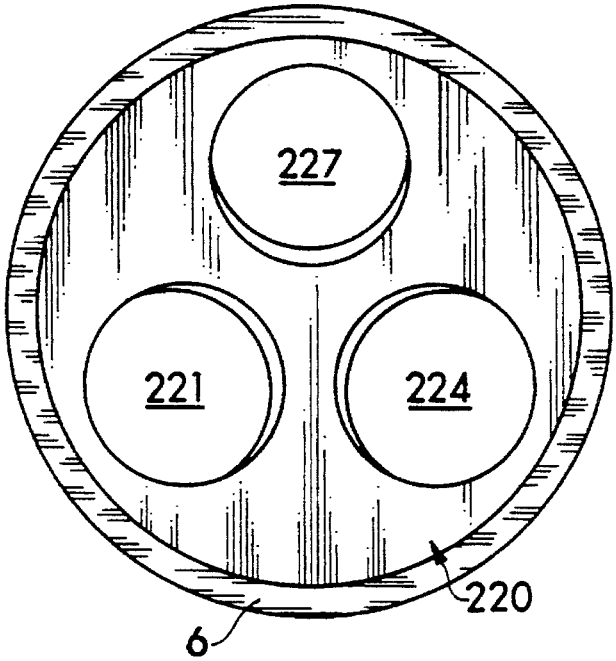
FIG. 15 is a top view of an insert having three bores therethrough as positioned in and supported by the wellhead assembly of the present invention.
Figure 16:
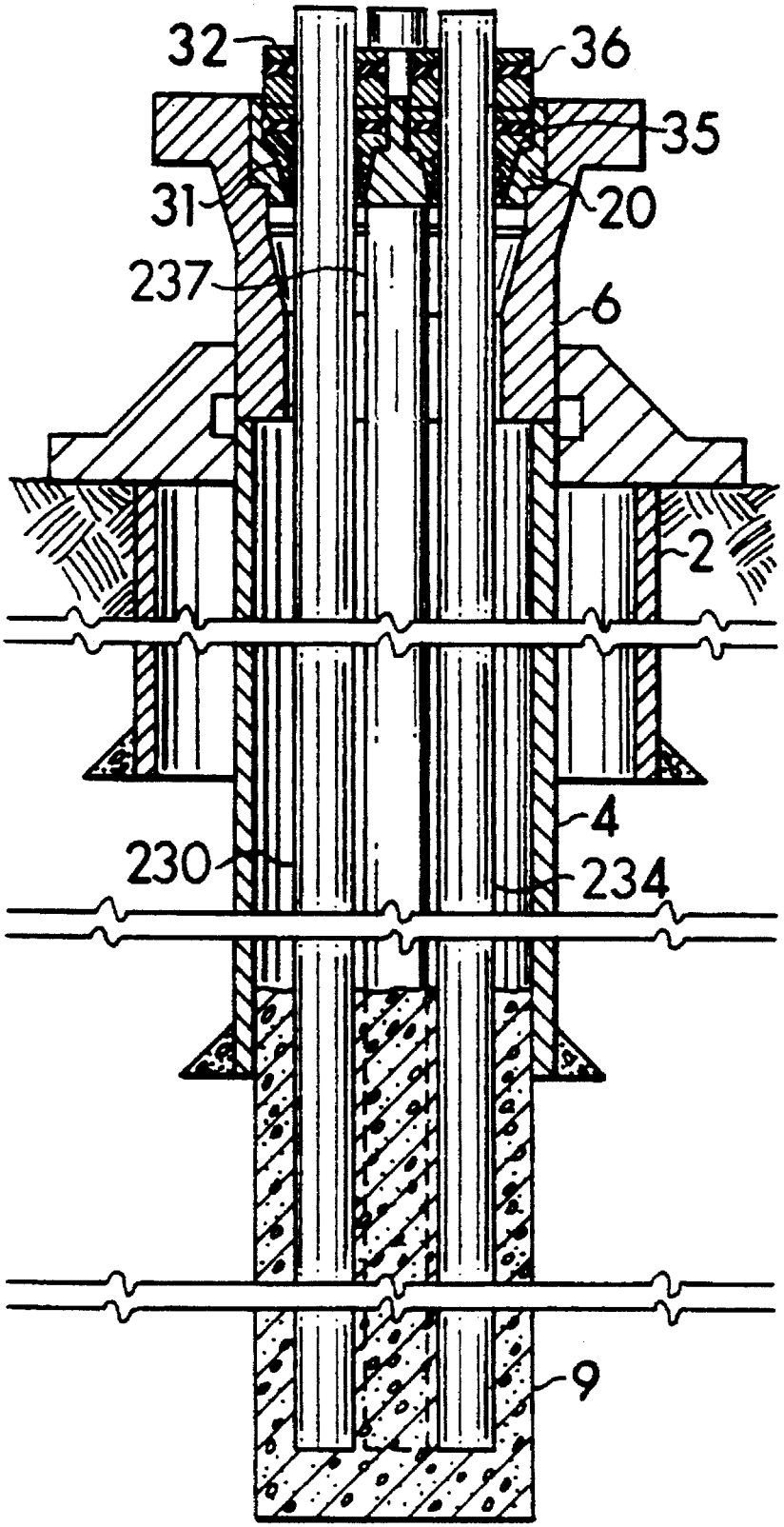
FIG. 16 is a sectional view of the assembly of the present invention illustrating three tubulars depending from the wellhead.

Although the insert of the assembly of the present invention has been illustrated and described as having two bores through which two separate lengths of surface casing are positioned, it will be evident to a skilled artisan that an insert can be provided with more than two bores and that more than two strings of surface casing can be positioned through such bores and within the surface well bore depending upon the diameter of the surface well bore and the surface casings inserted therein. For example, an insert 220 is provided with three bores 221, 224, and 227 (FIG. 15) therethrough and is positioned within and supported by the wellhead 6 in a manner as described above with respect to insert 20. Tubulars 230, 234, and 237 are positioned through bores 221, 224, and 227, respectively, (FIG. 16) and secured therein in a manner as described above with respect to tubulars 30 and 34. As constructed in this manner, the assembly of the present invention will permit three subterranean wells to be separately drilled and completed from a common or single well bore.

Further, it is within the scope of the present invention to provide tubulars of varying length which terminate at different positions within the common well bore, to secure whipstock(s) to the assembly below the point where such tubulars terminate, and/or to provide means for deviating the drill string emanating from such tubulars, for example mud motors, to ensure against well bore interference. In instances where a whipstock or additional downhole structural stability for the assembly of the present invention is desired, an elongated frame, for example I-beam(s), can be positioned between and secured to both first and second tubulars along the length thereof. If such elongated frame is utilized, it is preferred that such frame be secured to at least one of the tubulars by any suitable means, such as bolts, that a second tubular be stabbed into the template, and that both tubulars be positioned through generally C-shaped guides on each side of I-beam. Such generally C-shaped guides can be secured to the I-beam along the length thereof, such as by welds.

While the foregoing preferred embodiments of the invention have been described and shown, it is understood that the alternatives and modifications, such as those suggested and others, may be made thereto and fall within the scope of the invention.

We claim:

1. An assembly through which multiple subterranean wells can be separately drilled and completed from a common well bore, said assembly comprising:

a wellhead located at or near the surface of the earth and positioned over said common well bore;

a first tubular positioned within said common well bore, said first tubular being sized to permit passage of a drill string therethrough during drilling of a first subterranean well bore from said common well bore and to permit production casing to be positioned therethrough when said first subterranean well bore is completed;

a second tubular positioned within said common well bore, said second tubular being sized to permit passage of a drill string therethrough during drilling of a second subterranean well bore from said common well bore and to permit production casing to be positioned therethrough when said second subterranean well bore is completed; and means positioned at said wellhead for segregating and supporting said first and said second tubulars.

2. The assembly of claim 1 further comprising:

second means positioned within said well bore for segregating and supporting said first and said second tubulars.

3. The assembly of claim 1 wherein said means positioned at said wellhead for segregating and supporting said first and said second tubulars comprises a body having two bores therethrough which separately receive said first and said second tubulars, said body being supported by said wellhead.

4. The assembly of claim 1 further comprising:

a third tubular positioned within said common well bore, said third tubular being sized to permit passage of a drill string therethrough during drilling of a third subterranean well bore from said common well bore and to permit production casing to be positioned therein when said third well bore is completed, said means positioned at said wellhead segregating and supporting said third tubular in addition to said first and said second tubulars.

5. The assembly of claim 1 wherein said first and said second tubulars are cemented within said common well bore.

6. The assembly of claim 4 wherein said first, said second and said third tubulars are cemented within said common well bore.

7. A wellhead assembly comprising:

first means for segregating and supporting at least two tubulars which are positioned within a common subterranean well bore; and second means for supporting at least two production casings which extend into separate subterranean well bores drilled from said common subterranean well bore, one of said at least two production casings extending through one of said at least two tubulars and another of said at least two production casings extending through another of said at least two tubulars.

8. The wellhead assembly of claim 7 wherein a third tubular is positioned within said common subterranean well bore and is segregated and supported by said first means and wherein a third production casing extends into a separate subterranean well bore which is drilled from said common subterranean well bore, said third production casing being supported by said means and extending through said third tubular.

9. The wellhead assembly of claim 7 further comprising:

third means for supporting at least two production tubings, one of said at least two production tubings extending into one of said at least two production casings and another of said at least two production tubings extending into another of said at least two tubulars.

10. The wellhead assembly of claim 9 wherein a third tubular is positioned within said common subterranean well bore and is segregated and supported by said first means, wherein a third production casing extends into a separate subterranean well bore which is drilled from said common subterranean well bore, said third production casing being supported by said means and extending through said third tubular, and wherein a third production tubing is supported by said third means and extends into said third production casing.

11. The wellhead assembly of claim 9 further comprising:

a first production tree secured to said third means so as to be in fluid communication with one of said at least two production tubings; and a second production tree secured to said third means so as to be in fluid communication with another of said at least two production tubings.

12. A process of drilling and completing subterranean wells comprising:

suspending and separating at least two tubulars from a wellhead of a common well bore, said at least two tubulars being positioned within said common well bore;

drilling a first subterranean well bore through one of said at least two tubulars and into a subterranean formation; and securing a first length of production casing to said wellhead, said first length of production casing extending into said first well bore and being supported at said well head so as to establish fluid communication between the subterranean formation penetrated by said first well bore and the surface of the earth.

13. The process of claim 12 further comprising:

producing hydrocarbons from said subterranean formation penetrated by said first well bore to said surface of the earth via said first length of production casing.

14. The process of claim 12 further comprising:

positioning production tubing through said first length of production casing; and sealing the annulus defined between said first length of production casing and said production tubing.

15. The process of claim 14 further comprising:

producing hydrocarbons from said subterranean formation penetrated by said first well bore to said surface of the earth via said production tubing.

16. The process of claim 12 further comprising:

drilling a second subterranean well bore through the other of said at least two tubulars and into a subterranean formation; and securing a second length of production casing to said wellhead, said second length of production casing extending into said second well bore and being supported at said well head so as to establish fluid communication between the subterranean formation penetrated by said second well bore and the surface of the earth.

17. The process of claim 16 further comprising:

producing hydrocarbons from said subterranean formation penetrated by said second well bore to said surface of the earth via said second length of production casing.

18. The process of claim 16 further comprising:

positioning production tubing through said second length of production casing; and sealing the annulus defined between said second length of production casing and said production tubing.

19. The process of claim 18 further comprising:

producing hydrocarbons from said subterranean formation penetrated by said second well bore to said surface of the earth via said production tubing.

20. The process of claim 13 further comprising:

drilling a second subterranean well bore through the other of said at least two tubulars and into a subterranean formation; and securing a second length of production casing to said wellhead, said second length of production casing extending into said second well bore and being supported at said well head so as to establish fluid communication between the subterranean formation penetrated by said second well bore and the surface of the earth.

21. The process of claim 20 further comprising:

positioning production tubing through said second length of production casing; and sealing the annulus defined between said second length of production casing and said production tubing.

22. The process of claim 21 further comprising:

conducting a remedial operation via said second length of production casing; and concurrently, producing hydrocarbons from said subterranean formation penetrated by said first well bore to said surface via said production tubing positioned within said first length of production casing.

23. The process of claim 21 further comprising:

injecting a fluid into the subterranean formation penetrated by said second well bore via said second length of production casing; and concurrently, producing hydrocarbons from said subterranean formation penetrated by said first well bore to said surface via said production tubing positioned within said first lengths of production casing.

24. The process of claim 16 further comprising:

suspending and separating a third tubular from the wellhead of the common well bore, said third tubular being positioned within the common well bore;

drilling a third subterranean well bore through said third tubular and into a subterranean formation; and securing a third length of production casing to said wellhead, said third length of production casing extending into said third well bore and being supported at said well head so as to establish fluid communication between the subterranean formation penetrated by said third well bore and the surface of the earth.

25. The process of claim 24 further comprising:

producing hydrocarbons from said subterranean formation penetrated by said third well bore to said surface of the earth via said third length of production casing.

26. The process of claim 24 further comprising:

positioning production tubing through said third length of production casing; and sealing the annulus defined between said third length of production casing and said production tubing.

27. The process of claim 26 further comprising:

producing hydrocarbons from said subterranean formation penetrated by said third well bore to said surface of the earth via said production tubing.

28. The process of claim 16 wherein said subterranean formation penetrated by said first well bore and said subterranean formation penetrated by said second well bore are the same.

29. The process of claim 16 wherein said subterranean formation penetrated by said first well bore is distinct from said subterranean formation penetrated by said second well bore.

30. The process of claim 12 wherein said common well bore is generally vertical.

31. The process of claim 12 wherein said common well bore is deviated.

32. A process for drilling at least two subterranean well bores from a common well bore comprising:

positioning at least two tubulars within said common well bore;

drilling a first subterranean well bore through one of said at least two tubulars and into a first subterranean formation; and drilling a second subterranean well bore through the other of said at least two tubulars and into a second subterranean formation.

33. The process of claim 32 wherein said at least two tubulars are suspended from a common wellhead, said process further comprising:

sealing said other of said at least two tubulars against fluid flow prior to drilling said first subterranean well bore.

34. The process of claim 33 further comprising:

sealing said one of said at least two tubulars against fluid flow prior to drilling said second subterranean well bore.

35. The process of claim 32 wherein said first subterranean formation and said second subterranean formation are the same.

36. The process of claim 32 wherein said first subterranean formation is distinct from said second subterranean formation.

* * * * *